United States Patent [19]

Kohler

[11] 4,212,556

[45] Jul. 15, 1980

[54] STRIPER WHEEL ASSEMBLY

[75] Inventor: Henry A. Kohler, Orchard Park, N.Y.

[73] Assignee: Truly Magic Products, Inc., Buffalo, N.Y.

[21] Appl. No.: 921,949

[22] Filed: Jul. 5, 1978

[51] Int. Cl.[2] ..... B05C 17/02

[52] U.S. Cl. ..... 401/208; 118/212

[58] Field of Search ..... 118/211, 212, 221, 258, 118/259, 207; 401/208, 193; 33/36, 37, 41 C; 101/328, 329, 330

[56] References Cited

U.S. PATENT DOCUMENTS

| | | | |
|---|---|---|---|
| 342,484 | 5/1886 | Wade | 401/208 |
| 557,467 | 3/1896 | Wise | 401/208 |
| 1,965,753 | 7/1934 | Scoles | 401/176 |
| 2,229,008 | 1/1941 | Sohn et al. | 33/37 X |
| 2,582,861 | 1/1952 | Coombs | 401/208 |
| 2,721,347 | 10/1955 | Benkowski | 401/219 |
| 2,816,308 | 12/1957 | Schultz | 401/193 |
| 3,359,590 | 12/1967 | Perillo | 401/193 |
| 3,448,722 | 6/1969 | Krizman | 118/207 |

*Primary Examiner*—John P. McIntosh
*Attorney, Agent, or Firm*—Joseph P. Gastel

[57] ABSTRACT

A paint striper device including a cylindrical striper wheel having an outer annular portion of less width than the hub portion on which it is mounted, a housing portion of substantially complementary mating relationship for receiving segments of the outer cylindrical portion and the hub portion to provide good seals therewith, and alternating slots of different depth on the periphery of the outer cylindrical portion for receiving liquid from a container and depositing it on a surface in the form of a stripe.

9 Claims, 7 Drawing Figures

STRIPER WHEEL ASSEMBLY

BACKGROUND OF THE INVENTION

The present invention relates to an improved striping device of the type which is used to lay a stripe of material, such as paint, onto a surface.

In the past, various types of striping devices have been known. These devices generally included a striper wheel having an outer serrated surface which was journalled on a housing which was in communication with a container of paint or the like. Representative prior art stripers are exemplified by U.S. Pat. Nos. 342,484, 1,965,753, 2,582,861, 2,721,347, 3,359,590, 3,448,722 and 2,816,308. However, the prior art striping devices were subject to certain shortcomings, namely, the fact that there was leakage along the side of the striper wheel which caused the paint to be laid on a surface in an uneven manner and to also drip thereon. In addition, the use of serrations of uniform depth on the outer periphery of the wheel also contributed to the laying of an uneven stripe. It is with overcoming the foregoing deficiencies of the prior art that the present invention is concerned.

SUMMARY OF THE INVENTION

It is accordingly the object of the present invention to provide an improved paint striper which will lay a stripe of paint in a very even line by obviating substantial leakage between a slotted striper wheel and the housing on which it is mounted.

Another object of the present invention is to provide an improved paint striper which lays an even stripe by the use of a wheel having slots of different depth alternating with each other on its outer periphery. Other objects and attendant advantages of the present invention will readily be perceived hereafter.

The present invention relates to a paint striper device comprising a cylindrical striper wheel having an outer circumferential portion of a first thickness and a hub portion of a second thickness which is greater than said first thickness, and a wheel housing for mounting said striper wheel including openings of a width to receive a segment of said outer circumferential portion and a segment of said hub portion with a very close fit whereby said housing in conjunction with said first and second thicknesses of said striper wheel functions as a seal to prevent leakage. In accordance with another aspect of the present invention, the outer periphery of the striping wheel includes alternating relatively shallow and deep slots. The various aspects of the present invention will be more fully understood when the following portions of the specification are read in conjunction with the accompanying drawings wherein:

BRIEF DESCRIPTION OF THE DRAWINGS

FIG. 1 is a fragmentary perspective view of the improved striper wheel assembly of the present invention mounted on the neck of a container for paint or the like;

FIG. 2 is a fragmentary cross sectional view taken substantially along line 2—2 of FIG. 1;

FIG. 3 is a fragmentary cross sectional view taken substantially along line 3—3 of FIG. 1;

FIG. 4 is a bottom plan view of the improved striper wheel assembly;

FIG. 5 is a cross sectional view taken substantially along line 2—2 of FIG. 1 and showing the wheel housing;

FIG. 6 is a fragmentary enlarged side elevational view of the outer peripheral portion of the striper wheel showing the alternating slots of different depths; and FIG. 7 is a fragmentary perspective view of the end of the wheel housing mounting a tab for smoothing the paint stripe for certain applications.

DESCRIPTION OF THE PREFERRED EMBODIMENTS

Figures 1, 2, 3, 4, 5, 6, 7:
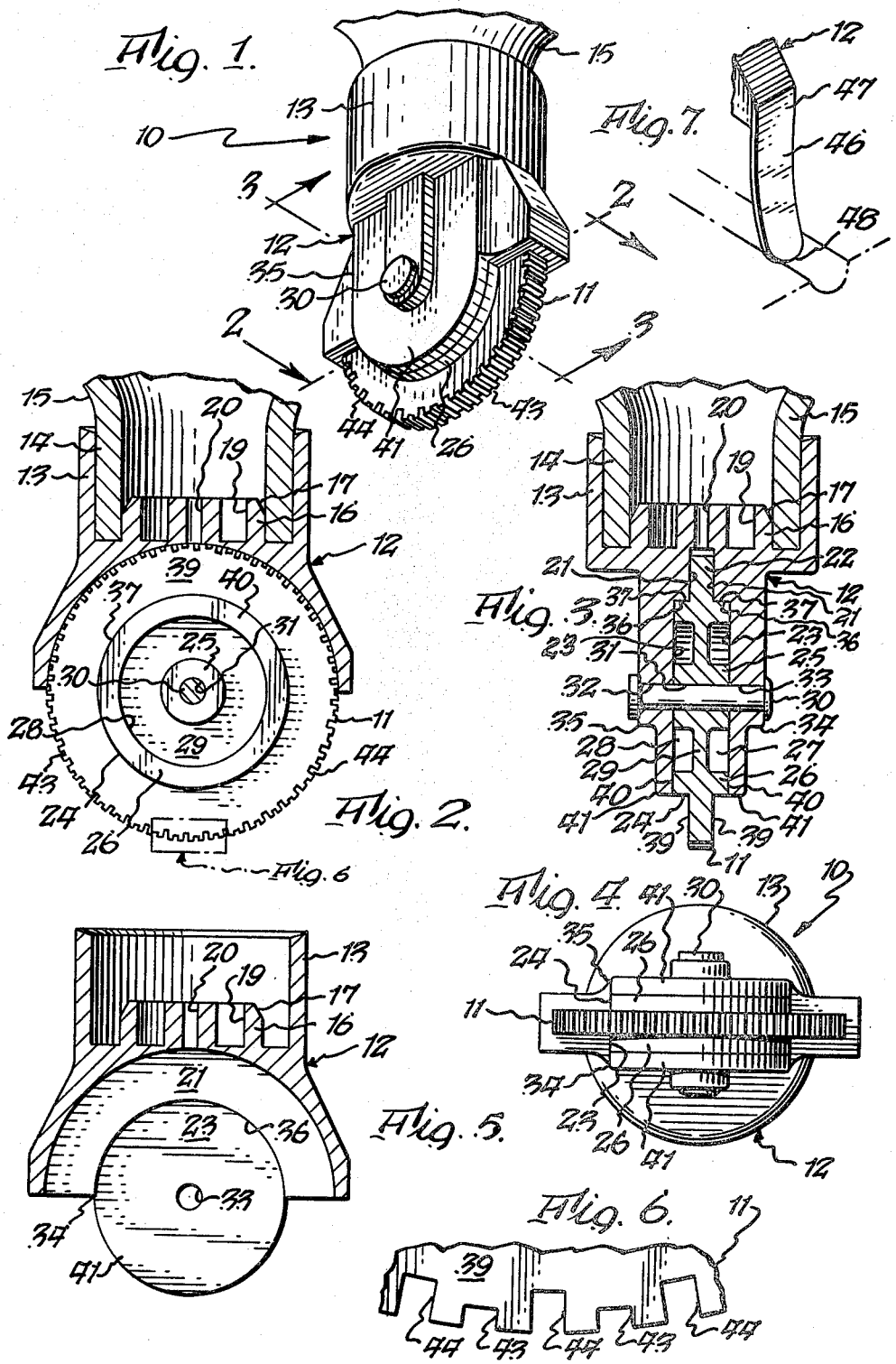

The improved striper wheel assembly 10 of the present invention includes a striper wheel 11 mounted in housing 12 having a neck 13 of a size to fit onto neck 14 of container 15 for paint or any other material which is to be laid onto a surface in the form of a stripe by rolling wheel 11 along said surface.

The wheel housing 12, in addition to including neck 13, also includes an annular insert portion 16 which fits into the mouth of the bottle. As can be seen, the outer edge of portion 16 is chamfered at 17 to slide into the mouth of the bottle. Furthermore, an annular groove 19 is provided so as to cause the cylindrical portion 16 to be flexible for a good fit with neck 14. A bore 20 is provided for feeding liquid from bottle 15 to wheel 11.

Housing 12 includes an opening in the form of a segment of a first cylindrical portion, defined by walls 21, in communication with bore 20 for receiving outer cylindrical portion 22 of wheel 11 with a relatively close fit. In this respect, the width of outer cylindrical portion 22 is substantially the same as the distance between walls 21. By way of specific example, in an actual device, the width of portion 22 is approximately 0.090 inches and the spacing of walls 21 is approximately 0.093 inches. Housing 12 also includes parallel circular walls 23 spaced to receive cylindrical hub portion 24 of wheel 11 with a close fit. In this respect, in an actual device, walls 23 are spaced approximately 0.218 inches apart, whereas the width of hub 24 is 0.215 inches.

Hub portion 24 consists of two concentric annular portions, namely, inner annular portion 25 and outer annular portion 26 which are separated by annular slots 27 and 28 on opposite sides of web portion 29. Mounting pin or axle 30 fits through bore 31 in hub portion 24 and also fits through aligned bores 32 and 33 in housing sides 34 and 35. Because the hub portion 24 is wider than outer portion 22, it can be mounted on sides 34 and 35 in an extremely stable manner, i.e., in a more stable manner than if the striper wheel was of the same thickness throughout as outer portion 22.

There are stepped portions at 37 where the hub portion 26 meets the outer cylindrical portion 22 of the wheel. There are corresponding mating stepped portions 36 in housing 12. There is an extremely close fit at these stepped portions 36 and 37. In this respect, in an actual device, the radius of surfaces 37 of hub portion 26 is approximately 0.342 inches and the radius of surfaces 36 is approximately 0.345 inches.

Leakage of paint is substantially prevented because there are very close tolerances betweeen walls 39 of the outer cylindrical portion 22 and mating walls 21, between the hub portions 26 and 25 and their mating walls 23, and between the surfaces 36 of the housing and the outer cylindrical surfaces 37 of the hub. Leakage is further prevented by the existence of annular slots 27 and 28. In this respect, in the event there should be some flow of liquid between the mating surfaces 21–39 and between the outer sides of annular portion 26 and sides 23 near the top of the housing, such flow will be received in annular slots 27 and 28 and will not tend to pass from these slots out through the space between the outer surfaces of annular hub portion 26 at 40 and its mating surfaces 23 at the lower portion of the housing. In other words, slots 27 and 38 will act as a reservoir for any flow downwardly from walls 21 of the housing, if any such flow should exist. It is to be especially noted that the lower parts of housing sides 34 and 35 at 41 are semicircular so as to match the size of the outer diameter of wheel hub portion 26.

Another factor which provides for extremely satisfactory paint striping is the fact that the outer peripheral surface of striper wheel 11 possesses alternating slots 43 of a first depth and 44 of a second depth. In actual practice the shallower slots 43 have been made approximately 0.015 inches and the deeper slots 44 have been made approximately 0.030 inches. The flow of paint or the like through bore 20 onto slots 43 and 44 is such that if or any reason there is an excess flow from bore 20 which is more than can be received by shallow slots 43, such excess will be received by slots 44, which can contain a greater amount of liquid. In the foregoing respect, bore 20 is of such a size that it will conduct only substantially enough liquid to fill shallow slots 43, and thus deeper slots 44 will only be about half full. The stripe laid from slots 43 and 44 under such conditions will be very even because the amounts deposited from slots 43 and 44 will merge with each other. Furthermore, the close tolerance between the surfaces of the outer slotted periphery of the wheel and the housing will prevent excess amounts of paint from being carried to the surface on which a stripe is being laid.

Summarizing, because of the close fit both axially and radially between the striper wheel and its housing and because of the stepped relationship between the striper wheel and its housing, undesired leakage of paint is obviated, and further because of the use of alternating shallow and deep slots on the surface of the striper wheel, an extremely even line of paint or the like can be laid down onto a surface. Preferably, the housing 12 and striper wheel 11 are molded of suitable plastic material. However, it will be appreciated that it can be made of metal, if desired.

The above-described paint striper is intended for use in applying a stripe of paint to a line of grouting between tiles to thereby whiten the grouting. However, it will be apprectiated that it can be used to lay an even stripe on any surface.

If desired, a flexible plastic tab 46 can be attached to end wall 47 of the housing to act on the paint being laid to smooth it out. The end of tab 46 preferably has a convex shape 48 to mate with the concave surface of the grout on which the paint is being striped. See FIG. 7.

While a preferred embodiment of the present invention has been disclosed, it will be apprexiated that it is not limited thereto but may be otherwise embodied within the scope of the following claims.

What is claimed is:

1. A striper device comprising a striper wheel having an outer periphery and an outer circumferential portion of a first thickness and a hub portion of a second thickness which is greater than said first thickness, a wheel housing, means for mounting said striper wheel for rotation on said wheel housing, means in said wheel housing for conducting liquid to said outer periphery, said wheel housing including first spaced housing portions spaced apart substantially the same amount as said first thickness for receiving a segment of said outer circumferential portion, and second spaced housing portions spaced apart substantially the same amount as said second thickness for receiving a segment of said hub portion, whereby said first and second spaced housing portions in conjunction with said segments of said outer circumferential portion and said hub portion, respectively, function as a seal to prevent leakage, said hub portion having a convex surface of a first radius, and said housing having a concave surface of a second radius of substantially the same size as said first radius whereby said hub portion and said housing include substantially touching cylindrical surfaces for providing additional sealing engagement between said striper wheel and said housing.

2. A striper device as set forth in claim 1 wherein said outer periphery has a convex surface of a third radius and wherein said housing includes a concave cylindrical surface of a fourth radius which is substantially the same as said third radius.

3. A striper device as set forth in claim 2 wherein said outer periphery includes first axial slots of a first depth and second axial slots of a second depth alternating with said first slots.

4. A striper device as set forth in claim 1 wherein said outer periphery includes first axial slots of a firstdepth and second axial slots of a second depth alternating with said first slots.

5. A striper device comprising a striper wheel, an outer periphery on said striper wheel, an outer circumferential portion of a first thickness on said striper wheel, a hub portion of a second thickness which is greater than said first thickness on said striper wheel, a wheel housing, means mounting said striper wheel for rotation on said housing, first housing portions spaced apart substantially the same amount as said first thickness for receiving a segment of said outer circumferential portion with a close fit to thereby provide a first seal between said striper wheel and said housing, a concave radius on said housing portion, a convex radius on said hub portion of substantially the same size as said concave radius for being received by said concave radius in substantially touching relationship to thereby provide a second seal between said striper wheel and said housing.

6. A paint striper device as set forth in claim 5 wherein said first portion of said striper wheel includes first spaced planar wall portions defining said first thickness, and wherein said first housing portions comprise second spaced planar wall portions.

7. A paint striper device as set forth in claim 5 wherein said hub portion includes an outer annular portion and an inner annular portion, and first and second axially spaced annular grooves on opposite sides of said hub portion between said inner and outer annular portions.

8. A paint striper device as set forth in claim 5 wherein said outer periphery is of a first convex radius, and wherein said housing includes a second concave radius of substantially the same size as said first radius for receiving said outer periphery with a close fit.

9. A paint striper device as set forth in claim 8 wherein said outer periphery includes first axial slots of a first depth and second axial slots of a second depth alternating with said first slots.

* * * * *